US009202657B1

(12) United States Patent
Resnick et al.

(10) Patent No.: US 9,202,657 B1
(45) Date of Patent: Dec. 1, 2015

(54) FULLY INTEGRATED AND ENCAPSULATED MICRO-FABRICATED VACUUM DIODE AND METHOD OF MANUFACTURING SAME

(71) Applicant: Sandia Corporation, Albuquerque, NM (US)

(72) Inventors: Paul J. Resnick, Albuquerque, NM (US); Eric Langlois, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 27 days.

(21) Appl. No.: 14/340,012

(22) Filed: Jul. 24, 2014

Related U.S. Application Data

(62) Division of application No. 13/298,448, filed on Nov. 17, 2011, now Pat. No. 8,814,622.

(51) Int. Cl.

| | |
|---|---|
| ***H01J 9/04*** | (2006.01) |
| ***H01J 3/02*** | (2006.01) |
| ***H01J 1/308*** | (2006.01) |
| ***H01J 1/304*** | (2006.01) |

(52) U.S. Cl.
CPC ..... *H01J 1/308* (2013.01); *H01J 1/3044* (2013.01)

(58) Field of Classification Search
CPC ..... H01J 3/022; H01J 9/025
See application file for complete search history.

(56) References Cited

U.S. PATENT DOCUMENTS

| | | | | |
|---|---|---|---|---|
| 5,055,077 | A | 10/1991 | Kane | |
| 5,142,184 | A | 8/1992 | Kane | |
| 5,266,530 | A * | 11/1993 | Bagley et al. | 438/20 |
| 5,534,743 | A | 7/1996 | Jones et al. | |
| 5,717,279 | A | 2/1998 | Imura | |
| 6,204,596 | B1 | 3/2001 | Macaulay et al. | |
| 6,329,214 | B1 | 12/2001 | Hattori et al. | |
| 6,808,952 | B1 | 10/2004 | Sniegowski et al. | |
| 8,384,281 | B2 | 2/2013 | Yamamoto et al. | |
| 8,536,564 | B1 | 9/2013 | Resnick et al. | |
| 2003/0057861 | A1 * | 3/2003 | Williams et al. | 315/169.3 |

OTHER PUBLICATIONS

U.S. Appl. No. 14/028,294, filed Sep. 16, 2013, Resnick et al.
Resnick PJ et al., "An Integrated field emission array for ion desorption," Microelectronic Engineering. May-Aug. 2010;87(5-8):1263-5.

* cited by examiner

*Primary Examiner* — Nimeshkumar Patel
*Assistant Examiner* — Jacob R Stern
(74) *Attorney, Agent, or Firm* — Helen S. Baca

(57) ABSTRACT

Disclosed is an encapsulated micro-diode and a method for producing same. The method comprises forming a plurality columns in the substrate with a respective tip disposed at a first end of the column, the tip defining a cathode of the diode; disposing a sacrificial oxide layer on the substrate, plurality of columns and respective tips; forming respective trenches in the sacrificial oxide layer around the columns; forming an opening in the sacrificial oxide layer to expose a portion of the tips; depositing a conductive material in of the opening and on a surface of the substrate to form an anode of the diode; and removing the sacrificial oxide layer.

12 Claims, 19 Drawing Sheets

PATTERN PHOTORESIST

ISOTROPIC Si ETCH

STRIP PHOTORESIST

OXIDE OVERBURDEN;
CMP

TRENCH ETCH

LOW STRESS SILICON NITRIDE DEPOSITION;
PATTERN ANODE

DRY/WET OXIDE ETCH

SACRIFICIAL SPACER OXIDE

ANODE DEPOSITION (E.G., CVD TUNGSTEN) & POLISH

OXIDE RECESS ETCH

2ND TUNGSTEN DEPOSITION; TUNGSTEN POLISH

ETCH RELEASE PORT

RELEASE ETCH

ANGLE PHYSICAL VAPOR DEPOSITION OF ENCAPSULATION METAL (E.G., ALUMINUM)

$E_{tip}$ (max) = 7,448 V/μm

FULLY INTEGRATED AND ENCAPSULATED MICRO-FABRICATED VACUUM DIODE AND METHOD OF MANUFACTURING SAME

CROSS-REFERENCE TO RELATED APPLICATION

This application is a divisional of prior U.S. application Ser. No. 13/298,448, filed Nov. 17, 2011, which is hereby incorporated by reference in its entirety.

STATEMENT REGARDING FEDERALLY SPONSORED RESEARCH

This invention was developed under Contract DE-AC04-94AL85000 between Sandia Corporation and the U.S. Department of Energy. The U.S. Government has certain rights in this invention.

FIELD OF THE INVENTION

The present invention relates generally to field emission arrays. Specifically, the present invention relates to a cold cathode field emission vacuum diode.

BACKGROUND OF THE INVENTION

Conventionally, field emission arrays have been fabricated using thin film deposition techniques, also known as Spindt tips. Electrons emitted from the cathode (Spindt tip) are accelerated by the electric field between the cathode and the anode electrode. The cathode has an approximately conical shape, to which a predetermined electric field is applied so as to emit electrons. Moreover, when producing this Spindt type of electron emission device, a hole having a diameter of about 1 micrometer is formed and inside this hole, the emitter electrode is formed by way of deposition or the like.

However, in such a Spindt type of electron emission devices, it is difficult to form the aforementioned conical emitter electrode with a desired configuration, therefore resulting in a device that does not have stable electron emission characteristic. In particular, when producing an emission array, it is necessary to uniformly form the emitter electrodes over a large substrate. In other words, unless the emitter electrodes are formed uniformly, the field electron emission characteristic varies depending on a position within the array.

SUMMARY OF THE INVENTION

The inventors of the present invention have now discovered a novel cold cathode field emission vacuum diode and method of producing same.

According to one aspect of the invention, an exemplary method for producing an encapsulated micro diode in a substrate comprises forming a plurality columns in the substrate with a respective tip disposed at a first end of the column, the tip defining a cathode of the diode; disposing a sacrificial oxide layer on the substrate, plurality of columns and respective tips; forming respective trenches in the sacrificial oxide layer around the columns; depositing a dielectric material in the trenches and on top of the sacrificial oxide; forming an opening in the dielectric material, extending into the sacrificial oxide but not so far as to expose a portion of the tips; depositing a conductive material in of the opening and on a surface of the dielectric to form an anode of the diode; and removing the sacrificial oxide layer.

According to another exemplary embodiment, the method further comprises forming a respective vent at an upper portion of the substrate adjacent the opening in the sacrificial oxide prior to depositing the conductive material, wherein the step of removing the sacrificial oxide includes introducing an etchant in the vent.

According to yet another exemplary embodiment, the method further comprises applying a vacuum through the vent prior to depositing a second conductive material such that the diode is sealed under vacuum.

According to still another aspect of the invention, a method for producing an encapsulated micro diode in a substrate comprises forming a plurality columns in the substrate with a respective tip disposed at a first end of the column, the tip defining a cathode of the diode; disposing a first sacrificial oxide layer on the substrate, plurality of columns and respective tips; forming respective trenches in the first sacrificial oxide layer around the columns; forming an opening in the first sacrificial oxide layer to expose a portion of the tips; disposing a second sacrificial oxide layer in a portion of the opening in order to conform to the exposed tip and form a spacer; depositing a conductive material in a remaining portion of the opening and on a surface of the substrate to form an anode of the diode, the anode conforming to a shape of the tip; and removing the first and second sacrificial oxide layers.

According to a further exemplary embodiment, the method further comprises forming a respective vent at an upper portion of the substrate adjacent the opening prior to depositing the conductive material, wherein the step of depositing the conductive material includes depositing the conductive material in the vent.

According to yet another exemplary embodiment, the method further comprises applying a vacuum through the vent prior to depositing the conductive material such that the diode is formed and sealed under vacuum.

According to still another exemplary embodiment, the tip is clad with tungsten.

According to yet a further exemplary embodiment, the conductive material is tungsten.

According to yet another aspect of the invention, a exemplary method for producing an encapsulated micro diode in a substrate comprises forming a plurality of trenches in the substrate to form columnar portions therein; depositing a first sacrificial oxide in the trenches and on a surface of the substrate; polishing the first sacrificial oxide to remove the sacrificial oxide from the surface of the substrate; disposing a resist layer on a portion of the surface of the columns; applying an etchant to form a tip in the substrate at a first end of the column; removing the resist layer to expose the formed tip; depositing a second sacrificial oxide layer on the substrate and exposed tip; etching a trench in the sacrificial oxide layer to form a column of oxide within which a respective column of the substrate is encapsulated; disposing an insulator in the trench and on a surface of the sacrificial oxide; forming an orifice in the insulator above a respective one of the formed tips; forming an opening in the sacrificial oxide layer in line with the orifice to expose a portion of the tips; disposing a third sacrificial oxide layer in a portion of the opening in order to conform to the exposed tip and form a spacer; depositing a conductive material in a remaining portion of the opening and on a surface of the substrate to form an anode of the diode, the anode conforming to a shape of the tip; and removing the sacrificial oxide layers.

According to a further aspect of the invention, an exemplary encapsulated micro diode comprises a plurality of columnar portions formed from a substrate having a pyramidal tip at a first end forming a cathode of the diode; an insulation layer disposed between adjacent ones of the columnar portions, the insulation layer overlying the columnar portion and having an aperture therethrough in a region overlying respective ones of the tips; and an anode formed through the aperture in the insulation layer and disposed above the cathode.

According to another exemplary embodiment, the anode conforms to a shape of the pyramidal tip.

According to yet another exemplary embodiment, the tip is disposed within an envelope of the anode.

According to still another exemplary embodiment, the micro diode includes a second aperture in the insulation layer above the columnar portion and adapted to provide a vacuum to the diode during formation of the anode.

According to a further exemplary embodiment, the tip is clad with tungsten.

According to another exemplary embodiment, the anode is formed from tungsten.

Common Aspects of all Embodiments—Fabrication Up to Anode Formation:

An exemplary method for producing an encapsulated micro diode in a substrate comprises forming a plurality of trenches in the substrate to form columnar portions therein; depositing a first sacrificial oxide in the trenches and on a surface of the substrate; polishing the first sacrificial oxide to remove the sacrificial oxide from the surface of the substrate; disposing a resist layer on a portion of the surface of the columns; applying an etchant to form a tip in the substrate at a first end of the column; removing the resist layer to expose the formed tip; depositing a second sacrificial oxide layer on the substrate and exposed tip; planarizing this second sacrificial oxide; etching a trench in the sacrificial oxide layer and silicon substrate material below to form a column of oxide within which a respective column of the substrate is encapsulated; disposing an insulator in the trench and on the surface of the sacrificial oxide; forming an orifice in the insulator above a respective one of the formed tips Anode Formation—Conformal Forming an opening in the sacrificial oxide layer in line with the orifice in the above nitride to expose a portion of the tips using a combination of dry and wet etching processes to modify anode geometry; disposing a third sacrificial oxide layer in a portion of the opening in order to conform to the exposed tip and form a sacrificial spacer film; depositing a conductive material in a remaining portion of the opening and on a surface of the substrate to form an anode of the diode, the anode conforming to a shape of the tip.

Anode Formation—Non-Conformal

Forming an opening in the sacrificial oxide layer in line with the orifice in the above nitride, using a combination of dry and wet etching processes to modify anode geometry, such as to approach the tips but not expose a portion of the tips; depositing a conductive material in a remaining portion of the opening and on a surface of the substrate to form an anode of the diode.

Common Aspects of all Embodiments:

The conducting anode material is polished to remove excess material from above the dielectric film; form a vent in the dielectric material adjacent to the anode structure; dispose an etchant into the vent to remove sacrificial oxide;

Common Aspects of all Embodiments: Vacuum Encapsulation:

Deposit conducting material in a non-conformal process at sufficient angle to minimize deposition below the nitride vent orifice;

According to a further exemplary embodiment, the conducting material is deposited at a thickness sufficient to seal the vent, forming a plurality of microcavities sealed at the vacuum level of deposition.

According to another exemplary embodiment, the conducting material is deposited at a thickness insufficient to seal the vent, forming a plurality of microcavities that are exposed to the environment.

These and other aspects of the invention will become evident in view of the detailed description and drawings.

BRIEF DESCRIPTION OF THE DRAWINGS

The invention is best understood from the following detailed description when read in connection with the accompanying drawings, in which.

DETAILED DESCRIPTION OF THE INVENTION

Figure 1A:
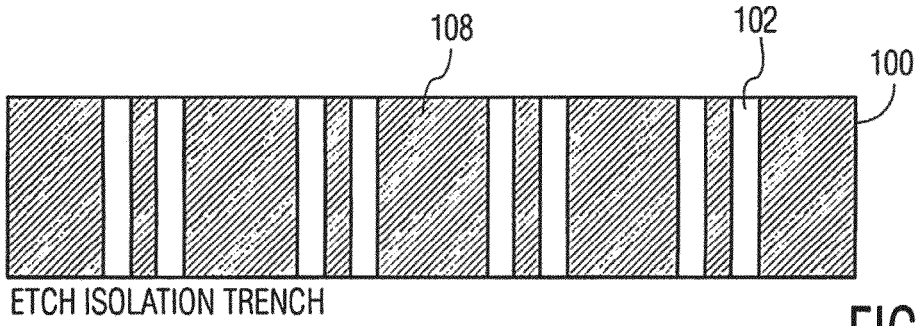
FIGS. 1*a*-1*f* are cross-sectional views illustrating steps for producing the tip portion of an encapsulated micro-diode in accordance with a first exemplary embodiment of the present invention.

Field emission arrays have traditionally been fabricated using thin film deposition techniques (known as Spindt tips). The inventors have discovered that the use of micro-electro-mechanical systems (MEMS) processing technology to fabricate a field emission vacuum diode has beneficial effects.

An exemplary device according to one aspect of the invention comprises an array of cold cathode field emitter tips, each associated with a blunt anode counter electrode. Both electrodes are in a vacuum cavity, created in-situ by physical vapor deposition of a metal film that seals the device at the deposition pressure, typically between 1E-03 and 1E-08 torr. An external vacuum chamber may also be incorporated to obtain sufficient vacuum levels.

When the exemplary device is forward biased, the field compression associated with the sharp tip of the cathode causes energy band bending that allows Fowler-Nordheim tunneling of electrons from the tip into vacuum, where they are attracted by the relative positive bias of the anode and collected. When the exemplary device is reverse biased, the rounded shape of the anode does not result in compression of the electric field lines.

While the field lines will still compress at the tip in reverse bias, the sign of the field is incorrect for electron emission. Without an intense field gradient at the anode surface, there is insufficient bending of the energy barrier for tunneling of electrons to occur. Current flow in reverse bias will be by field ionization rather than field emission. Field ionization occurs at local field gradients that are 3-10 times greater than field emission, thus producing asymmetrical current-voltage characteristics (diode behavior).

As would be understood by those skilled in the art the turn-on voltage of the exemplary device in forward bias operation is determined by the sharpness of the tip, the tip work function, the shape of the tip (half-angle of tip and shape of the shank), the gap between the cathode and the anode, and the vacuum level of the cavity. These same factors, except work function, will also affect reverse bias breakdown voltage. The onset of electron emission typically occurs at fields of 2-3 V/nm, while field ionization typically begins at about 10 V/nm or greater.

An exemplary fully integrated device is fabricated using MEMS processing technology. In one exemplary embodiment, the tip is fabricated from tungsten clad silicon. In an exemplary embodiment, the anode is comprised of tungsten, fabricated in a damascene process.

The damascene process uses both dry plasma and wet chemical etching to create a mold into which chemical vapor deposition (CVD) tungsten is deposited. These etches can be modified to manipulate the shape of the anode. This provides a smooth, rounded anode to minimize field compression. The structures can be comprised of a single cathode/anode, or an array of many cathodes/anodes.

Arrays are used to increase the current carrying capacity of the device. Variability in the gap spacing between the anode and cathode across an array of structures can have profound impact on device performance. Tips that are closer to the anode will turn on before tips that are farther away, such that some tips may not turn on at all, while others may be stressed with higher fields, currents and temperatures. To minimize the variability between the tips and anodes, in one exemplary embodiment, a sacrificial film is used as a spacer. The sacrificial film, an oxide deposited by CVD, for example, is highly uniform, thus creating a highly uniform gap between the tip and the anode. This type of anode is later referred to herein by the inventors as a conformal anode.

Furthermore, the inventors have conducted numerical simulation which indicates that the resulting conformal shape of the anode over the cathode enhances the electric field at the cathode, as compared to a simple, flat anode. The increased field reduces the turn-on voltage, and increases the tunneling current at a given operating voltage.

Figure 13A:
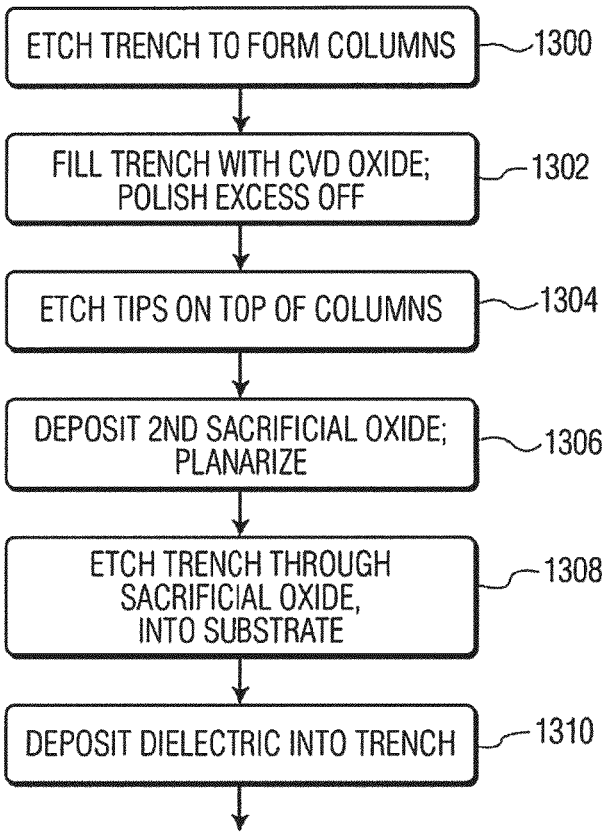
FIGS. 13*a*-13*c* are a flow chart outlining a process according to an exemplary embodiment of the present invention.
Figure 13B:
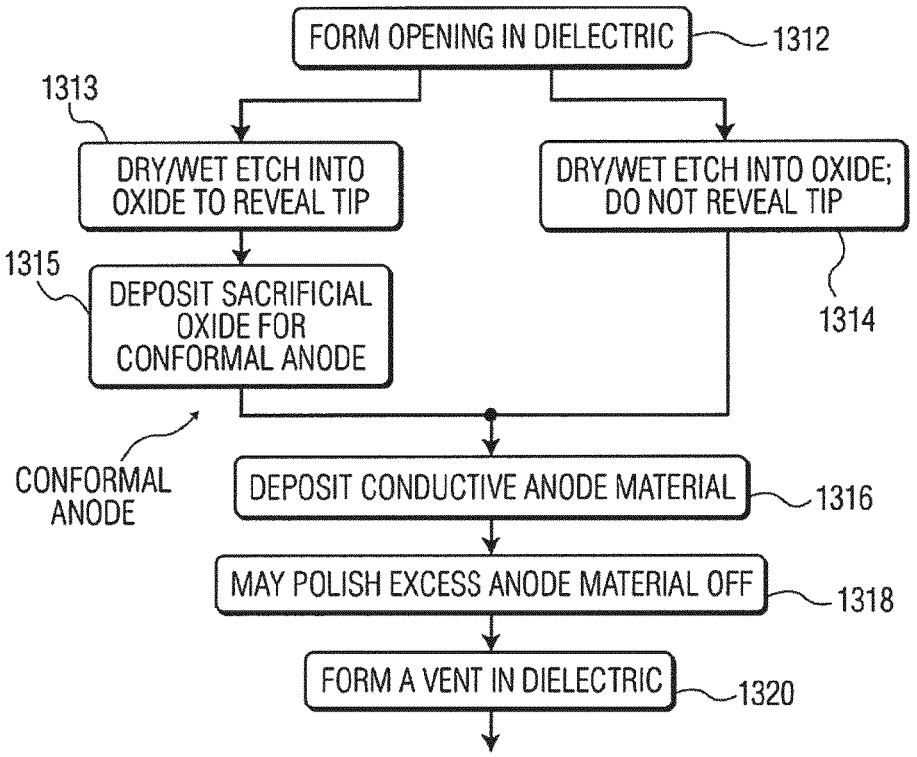
Figure 13C:
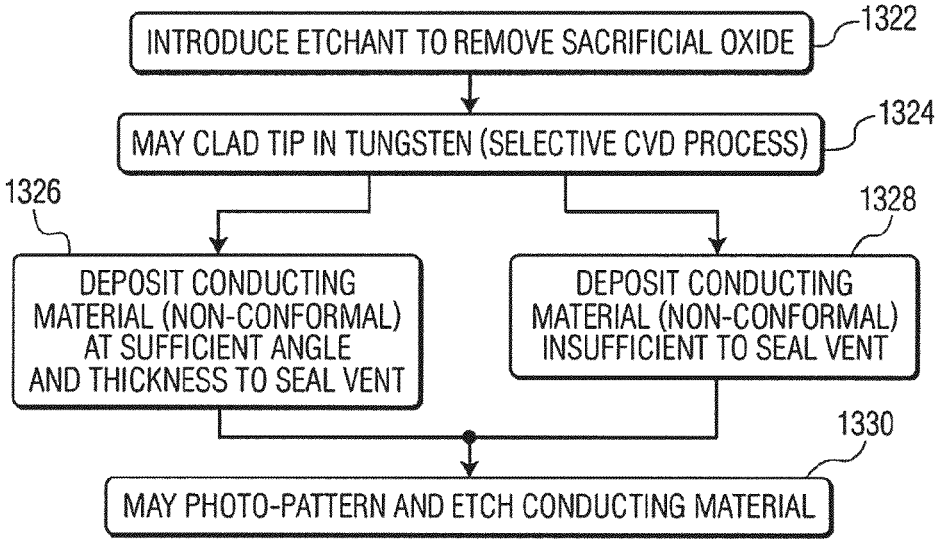

Referring to FIGS. 1*a*-1*f* are cross-sectional views illustrating steps for producing the tip portion of an encapsulated micro-diode in accordance with a first exemplary embodiment of the present invention. Reference will also be made herein to the steps 1300-1330 outlined in FIGS. 13*a*-13*c* as appropriate.

Figure 2:
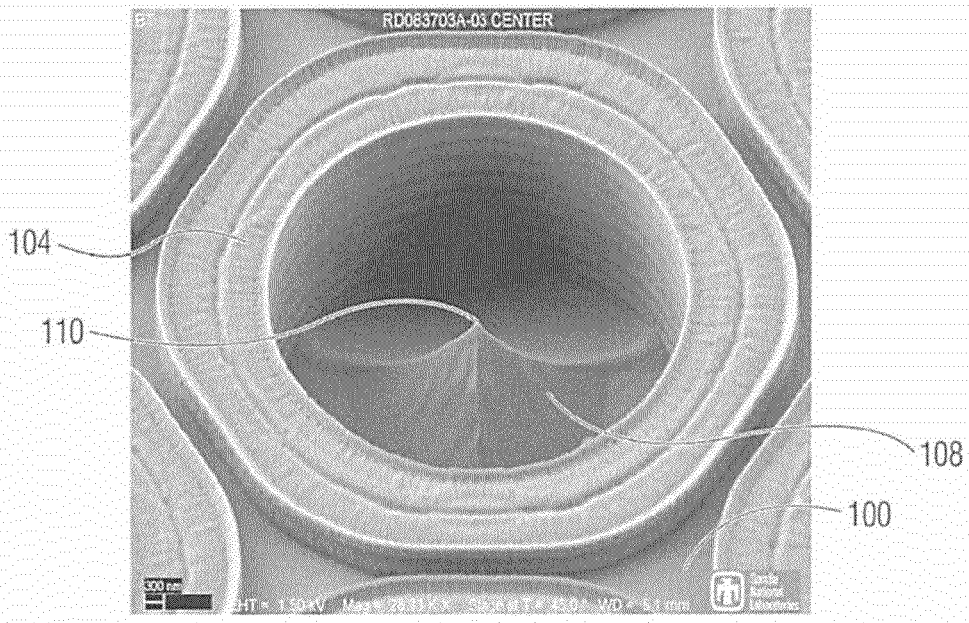
FIG. 2 is an SEM micrograph of the tip produced in according with the process of FIGS. 1*a*-1*f;*

As shown in FIG. 1*a* isolation trenches 102 are etched into substrate 100 (Step 1300), such as silicon or another semiconductor material, using known semiconductor processing techniques. As viewed from the top (see FIG. 2 for example), trenches 102 are circumferential such that they form columns 108 in substrate 100. Columns 108 will ultimately form the cathode of the exemplary embodiment and may thus also be referred to herein as cathode 108. It is understood that although trenches 102 are shown as extending through substrate 100, in fact there is substrate material below the trench area as illustrated in the micrographs shown in FIGS. 4, 6, 7*d*, 8*a* and 8*b* for example.

Figure 1B:
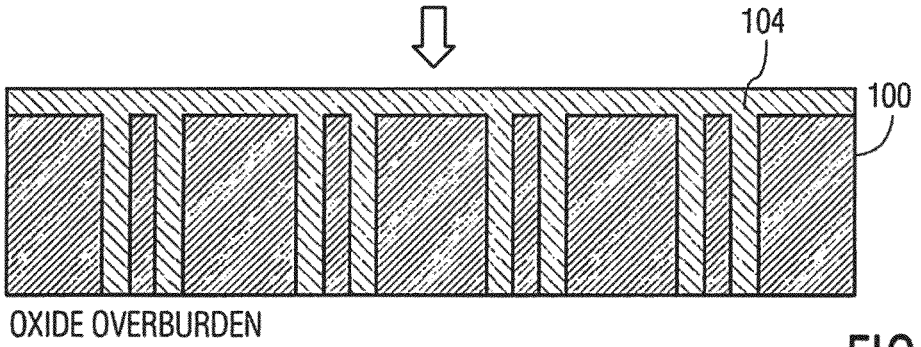

As shown in FIG. 1*b* a sacrificial oxide 104 is disposed in trenches 102 and on the surface of substrate 100 (Step 1302). This process is sometimes referred to as oxide overburden. Sacrificial oxide 104 will ultimately be etched away at the completion of processing to create a vacuum moat.

Figure 1C:
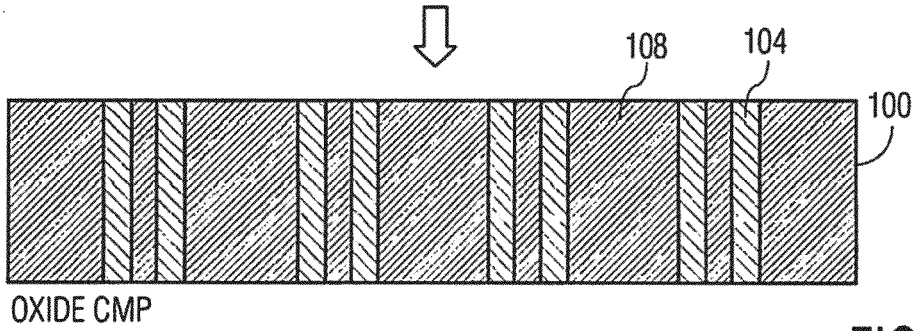

Next, as shown in FIG. 1*c*, oxide 104 is removed from the upper surface of substrate 100 by chemical mechanical planarization (CMP), as is well understood by those skilled in the art, resulting in oxide 104 remaining in trenches 102 (Step 1302).

Figure 1D:
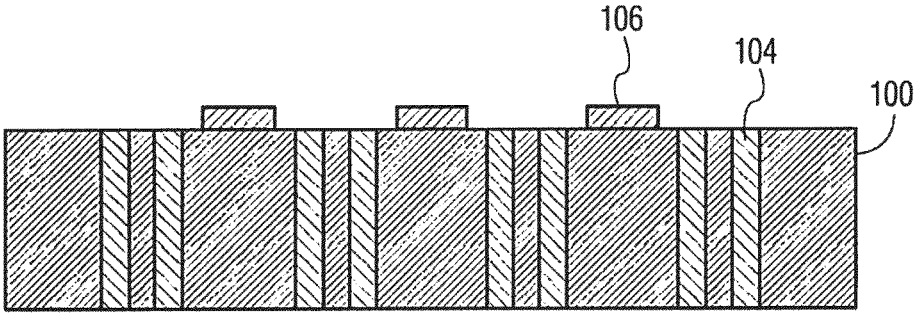
Figure 1E:
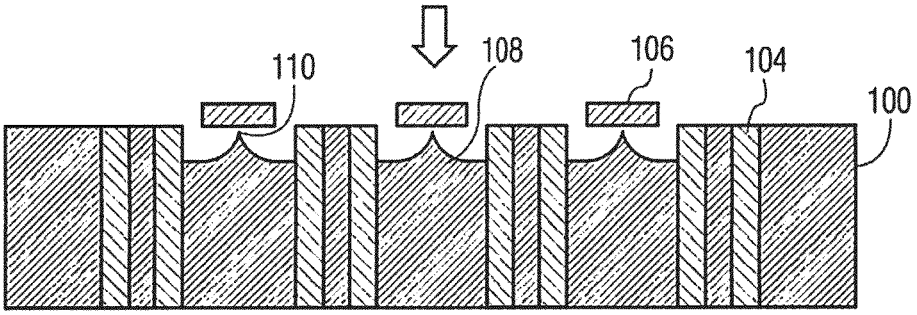

Next, as shown in FIG. 1*d*, photo resist 106 is patterned on the upper surface of columns 108. This is followed in FIG. 1*e* by an isotropic etch of substrate 100 in the areas of columns 108 resulting in the formation of the cathode of the exemplary micro-diode (Step 1304). Other areas of substrate 100 that are not desired to be etched are protected using known means (not shown for simplicity).

Figure 1F:
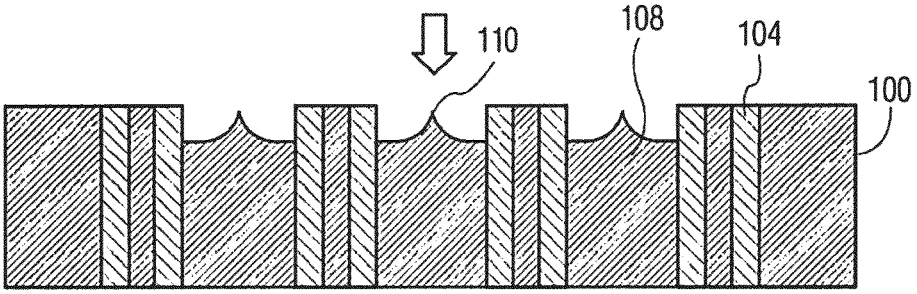

Next, as shown in FIG. 1*f*, photo resist 106 is stripped from substrate 100 resulting in columns 108 revealing a pronounced tip 110 of the cathode having a pyramidal shape, for example. At this point, oxide 104 still surrounds columns 108. This is best shown in the micrograph illustrated in FIG. 2.

Figure 3A:
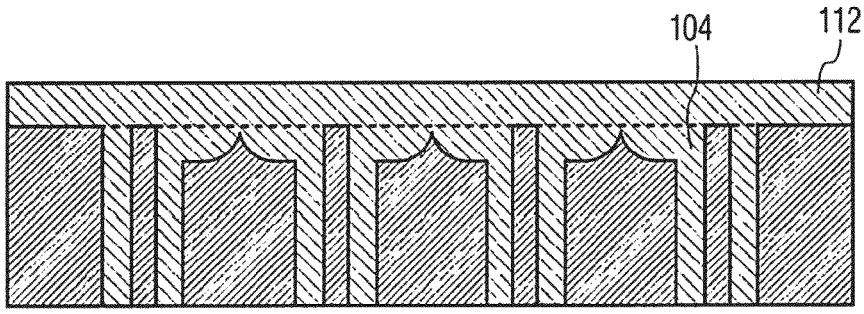
FIGS. 3*a*-3*c* are cross-sectional views illustrating further process steps for producing the encapsulated micro-diode in accordance with the first exemplary embodiment of the present invention.
Figure 3B:
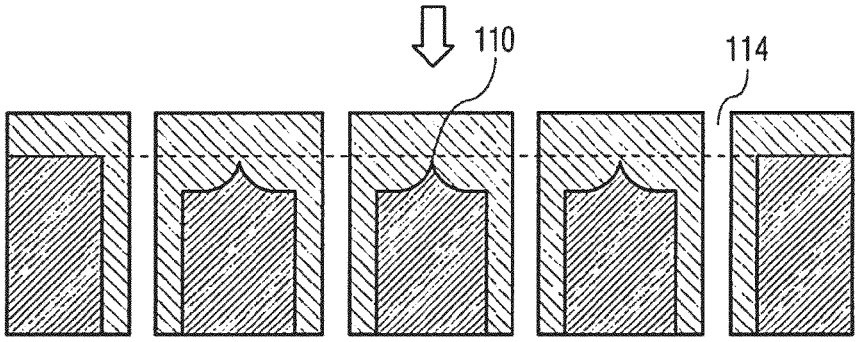

Next, as shown in FIG. 3*a*, a second sacrificial oxide 112 is placed over the surface of substrate 100 and into the area of column 108 that was etched away in a previous step (Step 1306). Next, as shown in FIG. 3*b*, a trench 114 (circumferential in nature) is formed in substrate 100 so as to remove a portion of oxide 112 as well as the portion of substrate 100 that was disposed between columns 108 (Step 1308). Again, for simplicity of the figures, the portion of substrate 100 that exists below columns 108 and trench 114 is not show in this figure, but is readily understood to those skilled in the art to be present, especially when FIGS. 4, 6, 7*d*, 8*a* and 8*b* are considered. It is contemplated that a trench 114 may extend beyond what is shown in FIG. 3*b* and into the underlying substrate (not shown in this figure—refer to FIG. 6 for example to illustrate this).

Figure 3C:
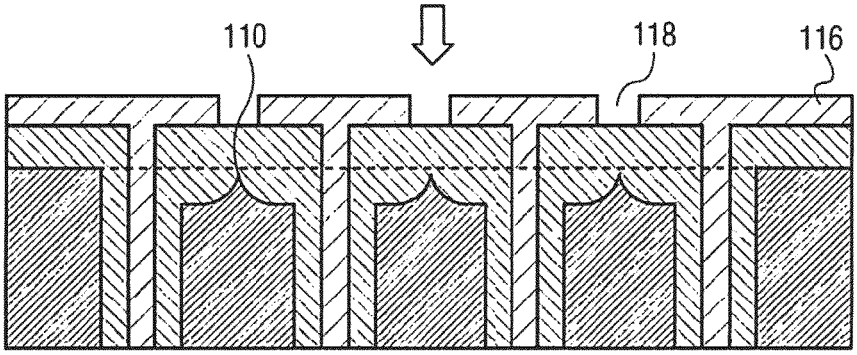

Next, as shown in FIG. 3*c*, an insulator 116, such as low stress silicon nitride, for example, is disposed in trenches 114 and on the surface of oxide 114 (Step 1310). A portion of insulator is then removed using known techniques to form a place 118 (void) for the anode of the inventors' micro-diode to be formed (Step 1312). Alternatively, a mask may be placed on the surface of oxide 112 in the positions corresponding to the anodes to be formed, followed by deposition of the insulator which is then followed by removal of the mask thus resulting in the formation of void 118.

Figure 4:
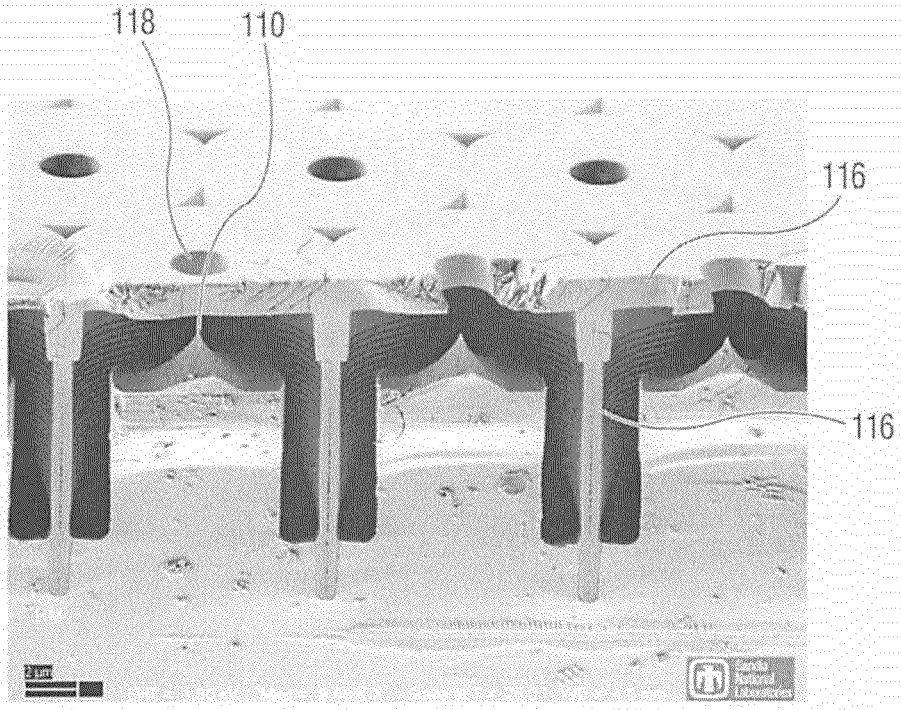
FIG. 4 is an SEM micrograph of the encapsulated micro-diode of FIGS. 3*a*-3, after anode etch with the sacrificial oxide removed for clarity.

FIG. 4 is an SEM micrograph of the encapsulated micro-diode of FIGS. 3*a*-3*c*, after anode etch with the sacrificial oxide removed for clarity.

Figure 5A:
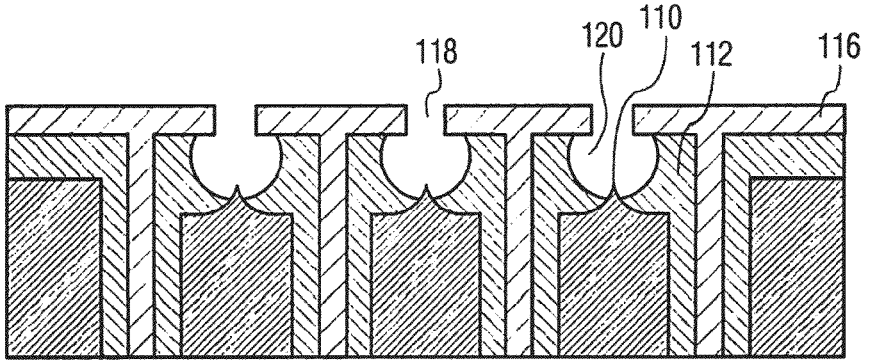
FIGS. 5*a*-5*h* are cross-sectional views illustrating still further process steps for producing the encapsulated micro-diode in accordance with the first exemplary embodiment of the present invention.
Figure 5B:
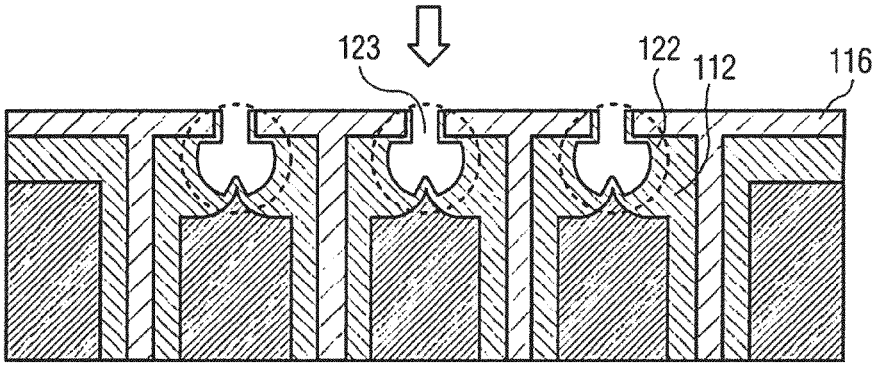
Figure 5C:
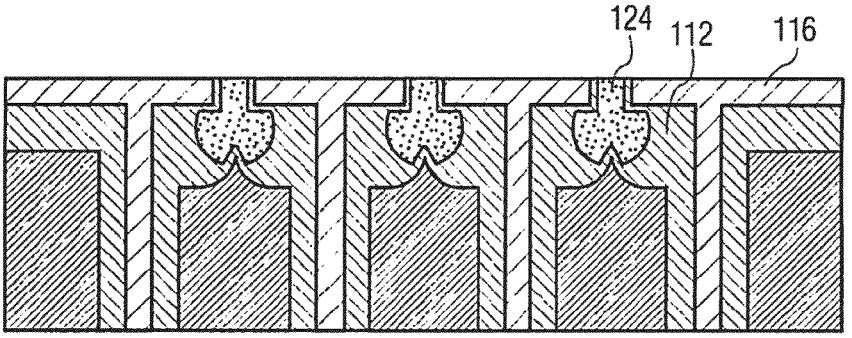

FIGS. 5*a*-5*c* are cross-sectional views illustrating further process steps for producing the encapsulated micro-diode in accordance with the first exemplary embodiment of the present invention. As shown in FIG. 5*a*, an conventional oxide etch is performed, through opening 118 in insulator 116, on oxide 112 to form a void 120, preferably having a substantially semi-circular cross section, for formation of the anode. It should be noted that in this exemplary embodiment, enough of oxide 112 is removed so as to expose cathode tip 110 (Step 1313).

Next, as shown in FIG. 5*b*, another sacrificial oxide layer 122 is disposed in void 120 to form a smaller void 123. As shown, the oxide 122 is disposed such that it conforms with the walls of void 120 and cathode tip 110. The thickness of oxide 122 is selected based on a desired distance between the cathode and the yet to be formed anode of the ultimate micro-diode (Step 1315).

Next, as shown in FIG. 5*c*, anode 124, formed from tungsten for example, is disposed in void 123 (Step 1316) and desirably planarized (Step 1318) to conform with the upper surface of insulator 116. Although tungsten is one preferable example, the invention is not so limited. Any conducting material that can be deposited by a conformal process (such as CVD, atomic layer deposition (ALD), or electroplating) are contemplated. This includes high work function materials such as gold, platinum, palladium, etc.

Figure 5D:
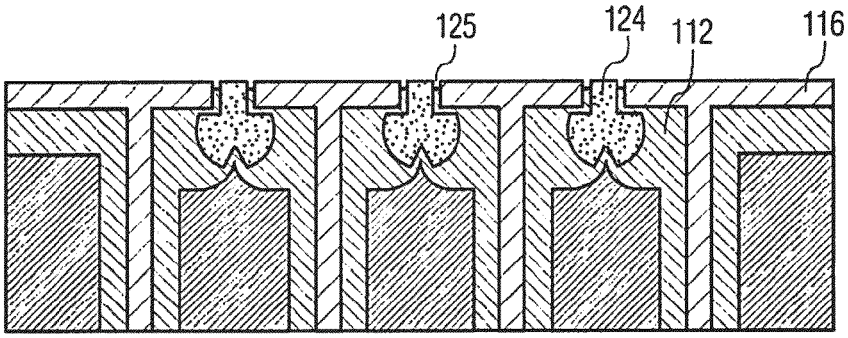
Figure 5E:
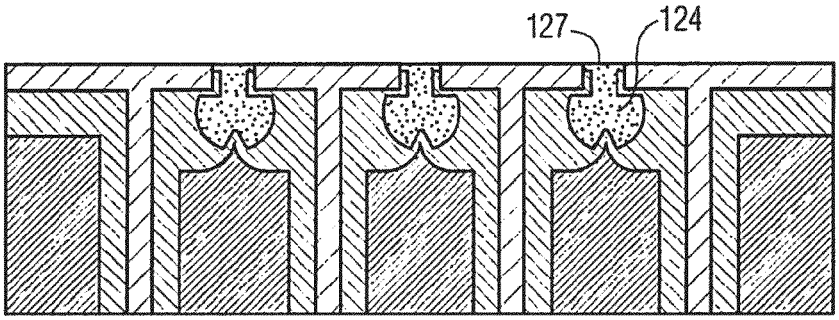

Next, as shown in FIG. 5*d*, an etch is performed to form a recess 125 in oxide 112, followed by a second metal deposition, such as with tungsten for example, to form a cap 127 on anode 124, as shown in FIG. 5*e*. The second metal deposition is also polished as necessary so that cap 127 is substantially level with the upper surface of insulator 116. As a result, anode 124 will be supported after the oxides are removed in subsequent steps (described below).

Figure 5F:
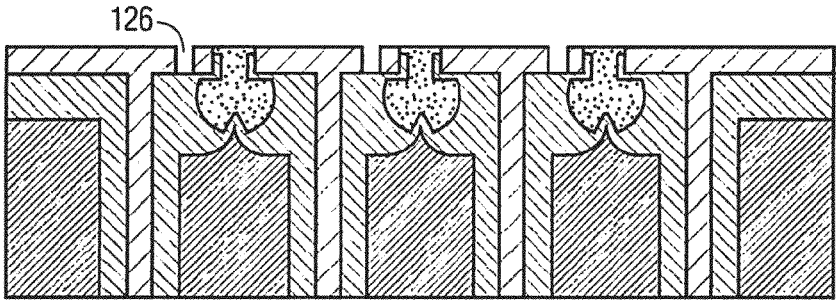
Figure 5G:
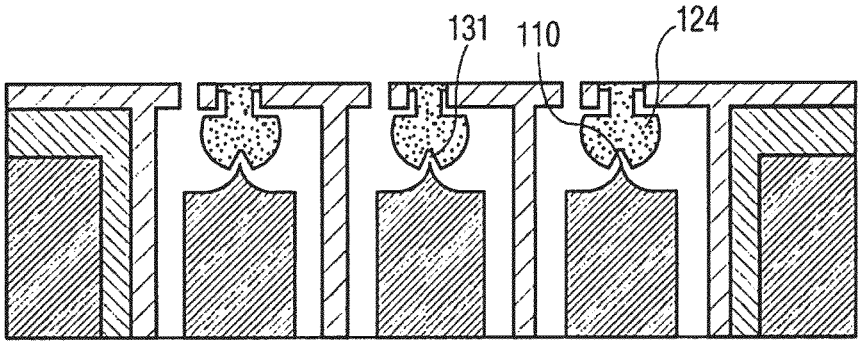

Next, as shown in FIG. 5*f*, an orifice 126 (vent) is formed in insulator 116 (Step 1320). Next, as shown in FIG. 5*g*, the previously formed oxide layers are removed using known techniques revealing a well defined space 131 between anode 124 and cathode tip 110 (Step 1322). The inventors refer to this type of anode as a conformal anode.

Although cathode tip 110 is formed from the material comprising substrate 100, the invention is not so limited. It is also contemplated that cathode tip 110 can be clad with a material such as tungsten (Step 1324).

Figure 5H:
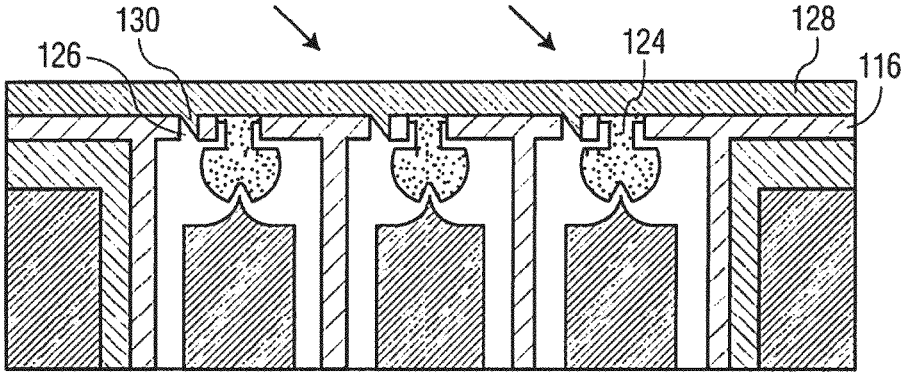

Next, as shown in FIG. 5*h*, the substrate may be subjected to a vacuum and a conductive layer 128 formed on the surface of insulator 116 and disposed within vent 126 forming plug 130, using angle physical vapor deposition, for example (Step 1326). Thus, the micro-diode may be formed in a vacuum state. Conductive layer 128 also provided electrical contact to anodes 124. Examples of conductive layer 128 include aluminum and tungsten. Any conductive material that can be deposited by physical vapor deposition, at an appropriate angle to the substrate, are also contemplated. Included among these are gold, nickel, titanium, etc.

This last metal deposition is non-conformal to prevent excessive metal deposition below vent 126. Preferably, this deposition is performed at an angle, so that the vent 126 can be choked off without deposition below the vent (which may cause electrical shorting). Consider, for example, a vent 126 with a 1 um diameter, through a 1 um thick nitride film, then an angle greater than 45 deg (from normal) is sufficient to seal the port without deposition below—as long as the deposition is line-of-sight.

Although the above embodiment illustrates that vent 126 is sealed with conductive layer 128, the invention is not so limited. It is also contemplated that vent 126 may remain unsealed (Step 1328) and be exposed to the environment such that it is useful as a vacuum sensor, gas ionization detector, or other electron/ion source with closely paired anode/cathode.

Next, at Step 1330, conductive layer 128 may be patterned and etched as desired.

Figure 6:
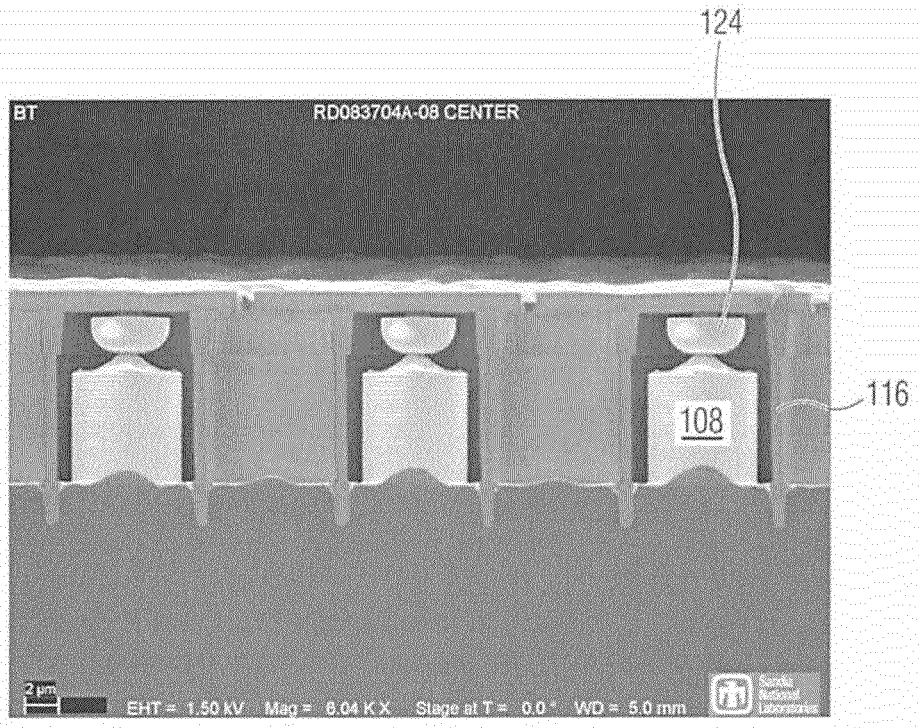
FIG. 6 is an SEM micrograph of the complete encapsulated micro-diode of in accordance with the first exemplary embodiment of the present invention.

FIG. 6 is an SEM micrograph of the complete encapsulated micro-diode in accordance with the first exemplary embodiment of the present invention, showing insulator 116, cathode 108 and anode 124. Tip 110 of cathode 108 is disposed within the envelope of anode 124 and thus not able to be seen in this figure. As mentioned above, insulator 116 extends beyond column 108 and into the underlying substrate.

FIGS. 7*a*-7*d* are SEM micrographs of additional views of the complete encapsulated micro-diode of the first exemplary embodiment. FIG. 7(*a*) is an enlarged view of the cathode 108, anode 124, cathode tip 110 (partially disposed within the envelope of anode 124), vent 126 and conductive layer 128.

Figure 7A:
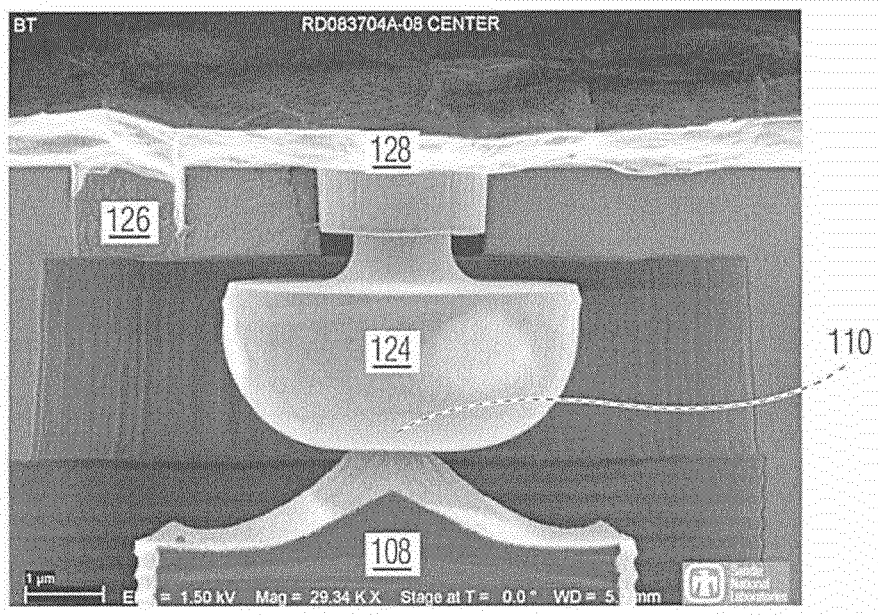
FIGS. 7*a*-7*d* are SEM micrographs of additional views of the complete encapsulated micro-diode of FIG. 6.
Figure 7B:
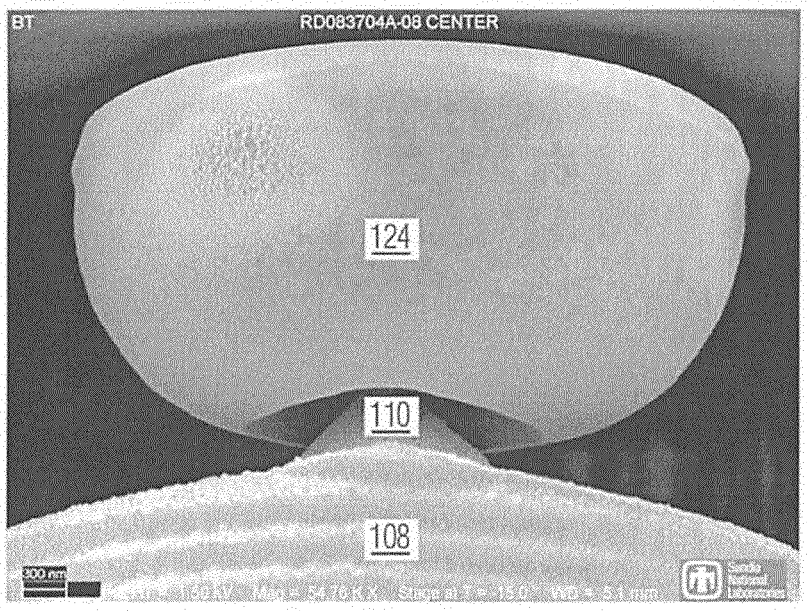
Figure 7C:
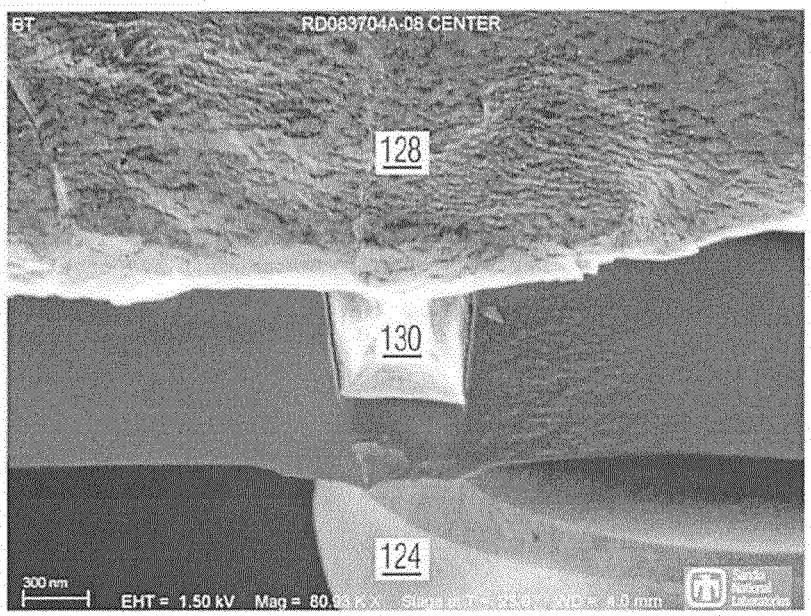
Figure 7D:
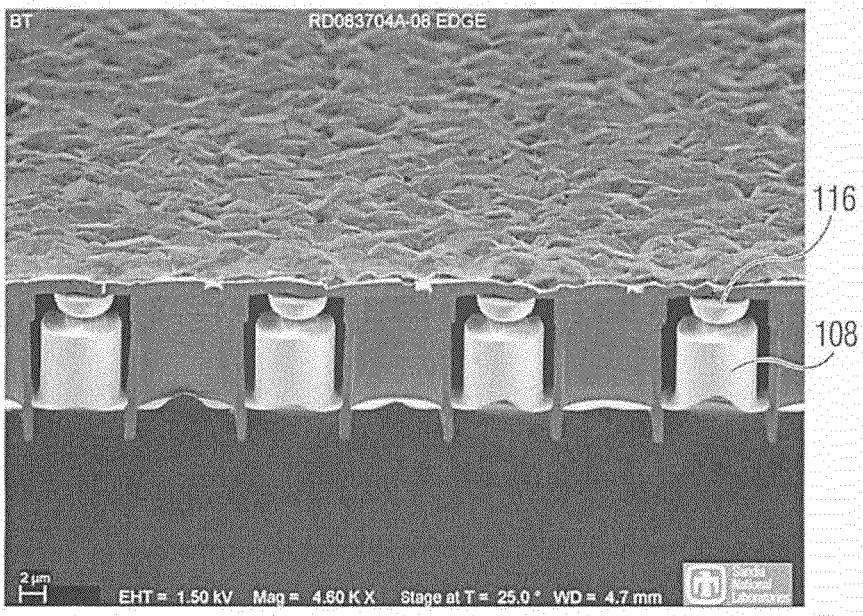

FIG. 7*b* is a view from below illustrating the spatial relationship between cathode tip 110 and anode 124. It is clear from this figure that cathode tip 110 is disposed within the envelope of anode 124. FIG. 7*c* is an enlarged view of vent 126 and plug 130, and FIG. 7*d* is a perspective view from above of a plurality of micro-diodes in accordance with the inventors' first exemplary embodiment.

Figure 8A:
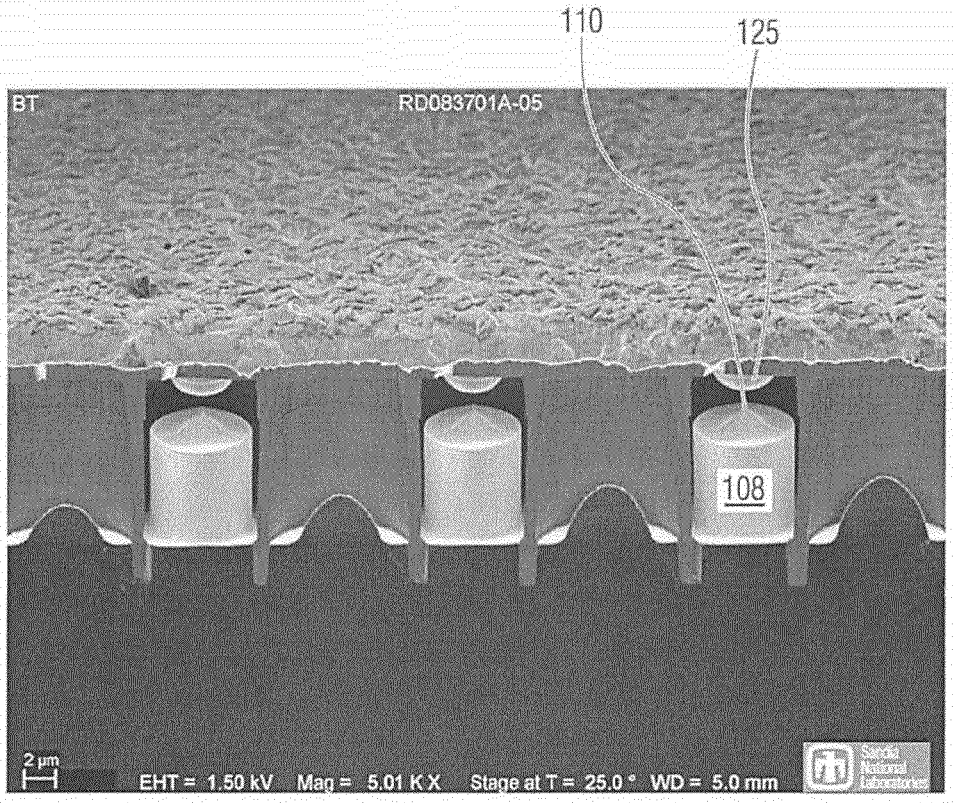
FIGS. 8*a*-8*b* are SEM micrographs of an encapsulated micro-diode in accordance with a second exemplary embodiment of the present invention.
Figure 8B:
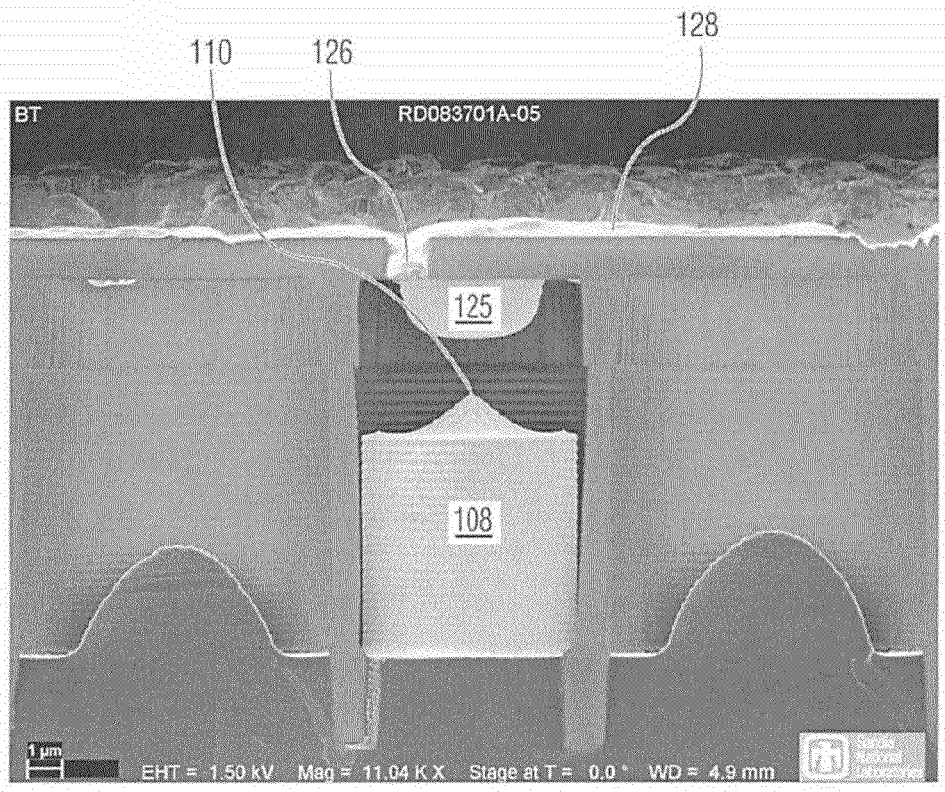

FIGS. 8*a*-8*b* are SEM micrographs of an encapsulated micro-diode in accordance with a second exemplary embodiment of the present invention. As can be readily seen in FIGS. 8*a* and 8*b*, cathode 108 and cathode tip 110 are formed in accordance with the first exemplary embodiment. The difference is in the formation of anode 125. In this embodiment, void 120, as discussed above with respect to FIG. 5*a*, is not formed so deep as to expose cathode tip 110. Rather it is formed as a shallow void so that cathode tip 110 remains encapsulated within oxide 112. The remaining process steps are the same, such that anode 125 is formed having a substantially smooth and curved surface disposed at a distance that is determined based on the desired biasing characteristics of the resultant micro-diode. The inventors refer to this type of anode as a non-conformal anode. The process steps for this embodiment are similar to those of the first exemplary embodiment except that in this embodiment, steps relating to the etch of the oxide to reveal the tip of the cathode (Step 1313) and deposition of the sacrificial oxide (Step 1315) are replaced with Step 1314 which is a Dry/wet etch into the oxide, where the tip of the cathode is not revealed.

Figure 9:
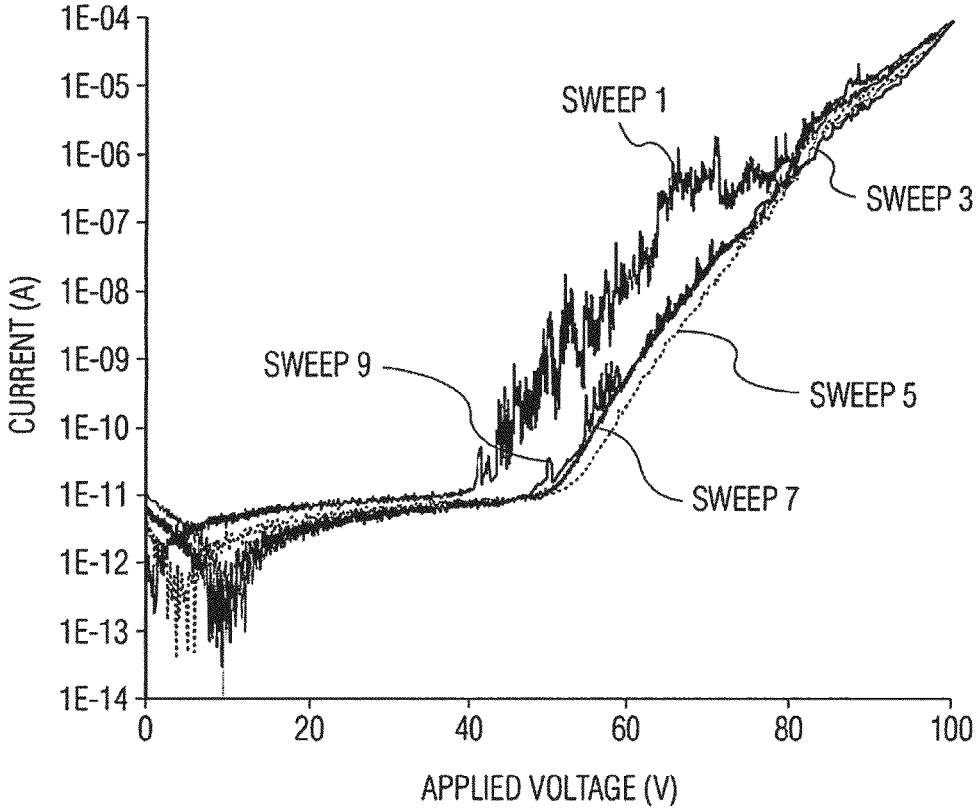
FIG. 9 is a graph of the exemplary micro-diode illustrating current versus voltage in a forward bias condition.

FIG. 9 is a graph of an exemplary micro-diode illustrating current versus voltage in a forward bias condition of a conformal anode device. In FIG. 9, five different V/I sweeps are shown. The inventors observed that the first sweep demonstrated greater noise than follow-on sweeps because of a lower turn-on voltage. The remaining sweeps demonstrated almost identical characteristics to each other. The space charge and/or series resistance had the effect of limiting current at high applied voltage conditions.

Figure 10:
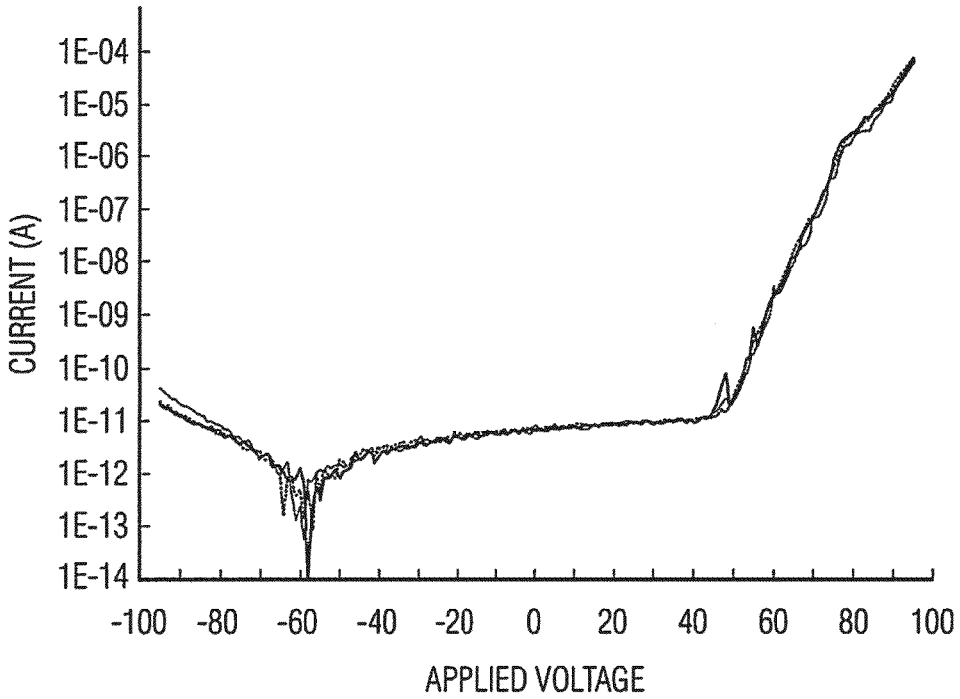
FIG. 10 is a graph of the exemplary micro-diode illustrating current versus voltage in both forward and reverse bias conditions.

FIG. 10 is a graph of the exemplary micro-diode illustrating current versus voltage in a both forward and reverse bias conditions. In FIG. 10, the sweeps were from −95V to +95V. Although a slight leakage current was observed, there was no breakdown in the diode under test. The noted dip in the V/I curve at about −60V is the crossover point superimposed with a positive displacement current.

Figure 11:
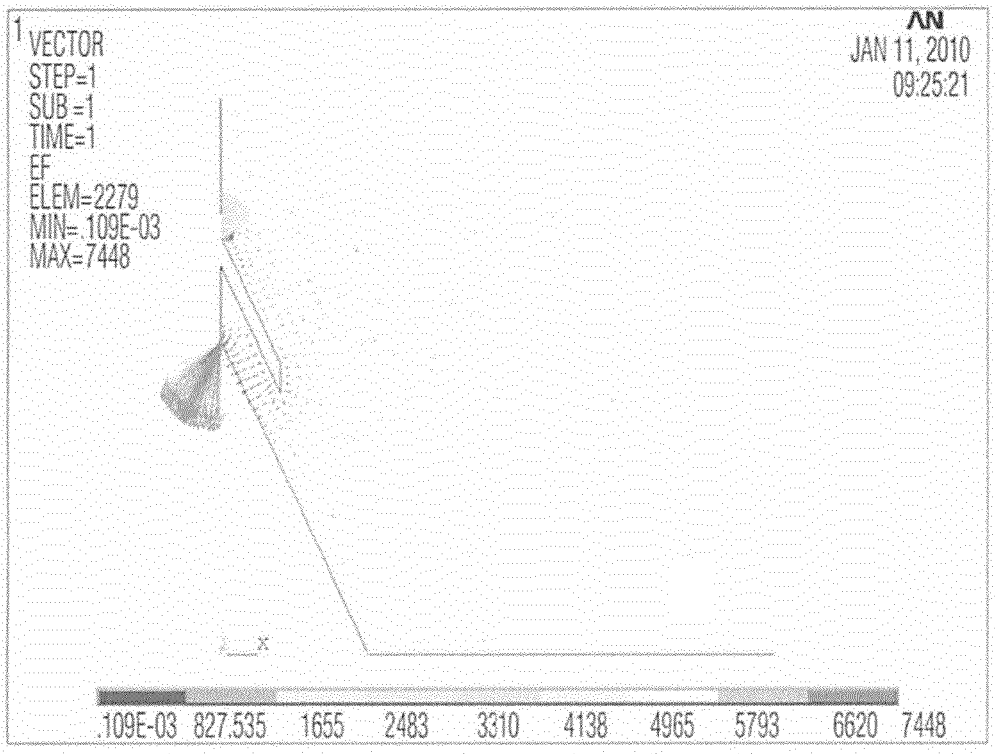
FIG. 11 is a graph of a simulation of the first exemplary embodiment of the present invention.
Figure 12:
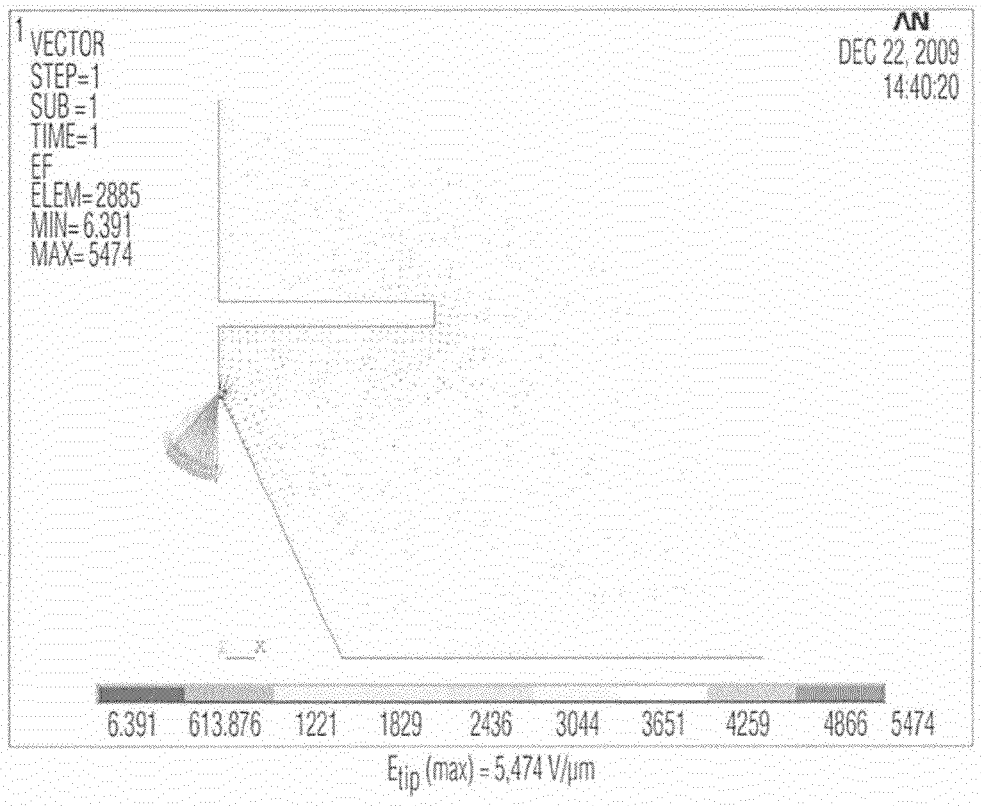
FIG. 12 is a graph of a simulation of the second exemplary embodiment of the present invention.

FIG. 11 is a graph of a simulation of the first exemplary embodiment of the present invention, and FIG. 12 is a graph of a simulation of the second exemplary embodiment of the present invention. These simulations suggest that the conformal anode embodiment produces an enhanced field at the tip of the cathode.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

The invention claimed is:

1. An encapsulated micro diode comprising:

a plurality of columnar portions formed from a substrate having a pyramidal tip at a first end forming a cathode of the diode;

an insulation layer disposed between adjacent ones of the columnar portions, the insulation layer overlying the columnar portion and having an aperture therethrough in a region overlying respective ones of the tips;

a conformal anode disposed above the cathode, wherein the anode conforms to a shape of the pyramidal tip; and an encapsulation metal disposed on a surface of the insulation layer.

2. The diode according to claim 1, wherein the tip is disposed within an envelope of the conformal anode.

3. The diode according to claim 1, further comprising a second aperture in the insulation layer above the columnar portion and adapted to provide a vacuum to the diode during formation of the conformal anode.

4. The diode according to claim 1, wherein the tip is clad with tungsten.

5. The diode according to claim 1, wherein the conformal anode is formed from tungsten.

6. The diode according to claim 1, further comprising a cap disposed on the conformal anode and within the aperture.

7. The diode according to claim 1, wherein the conformal anode is formed through the aperture in the insulation layer.

8. The diode according to claim 1, wherein each columnar portion comprises a pyramidal tip at a first end forming a cathode of the diode.

9. The diode according to claim 8, wherein the insulation layer comprises a plurality of apertures and each aperture overlies each of the pyramidal tips.

10. The diode according to claim 9, further comprising a plurality of conformal anodes, wherein each conformal anode is disposed above each of the pyramidal tips.

11. An encapsulated micro diode comprising:

a plurality of columnar portions formed from a substrate, wherein each columnar portion has a pyramidal tip at a first end forming a cathode of the diode;

an insulation layer disposed between adjacent ones of the columnar portions, the insulation layer overlying the columnar portion and having a plurality of apertures therethrough, wherein each aperture overlies each of the pyramidal tips;

a plurality of anodes, wherein each anode is disposed above each of the cathodes, wherein each of the anodes is a conformal anode that conforms to a shape of the pyramidal tip; and an encapsulation metal disposed on a surface of the insulation layer.

12. The diode according to claim 11, wherein each of the anodes is formed through each of the apertures in the insulation layer.

* * * * *